US008042931B2

(12) United States Patent
Hiroki et al.

(10) Patent No.: US 8,042,931 B2
(45) **Date of Patent: *Oct. 25, 2011**

(54) METHOD AND APPARATUS FOR FORMING IMAGE

(75) Inventors: Masashi Hiroki, Yokohama (JP); Satoshi Kaiho, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 556 days.

This patent is subject to a terminal disclaimer.

(21) Appl. No.: 11/619,730

(22) Filed: Jan. 4, 2007

(65) Prior Publication Data

US 2008/0165242 A1 Jul. 10, 2008

(51) Int. Cl.

| | |
|---|---|
| ***B65H 5/00*** | (2006.01) |
| ***B41J 2/01*** | (2006.01) |
| ***B41J 2/385*** | (2006.01) |
| ***B41J 2/325*** | (2006.01) |
| ***B41J 2/435*** | (2006.01) |

(52) U.S. Cl. ..... 347/104; 347/153; 347/215; 347/262; 347/264; 271/10.1; 271/225; 271/264

(58) Field of Classification Search ..... 271/8.1, 271/264, 265.01; 347/104; 399/361, 391
See application file for complete search history.

(56) References Cited

U.S. PATENT DOCUMENTS

| | | | | |
|---|---|---|---|---|
| 2003/0063936 | A1* | 4/2003 | Sasaki et al. | 399/401 |
| 2005/0194730 | A1* | 9/2005 | Nishida et al. | 271/10.01 |
| 2008/0165215 | A1 | 7/2008 | Hiroki et al. | |
| 2008/0165218 | A1 | 7/2008 | Hiroki et al. | |
| 2008/0165220 | A1 | 7/2008 | Hiroki et al. | |
| 2008/0165231 | A1 | 7/2008 | Hiroki et al. | |
| 2008/0165236 | A1 | 7/2008 | Hiroki et al. | |
| 2008/0165238 | A1 | 7/2008 | Hiroki et al. | |
| 2008/0165239 | A1 | 7/2008 | Hiroki et al. | |
| 2008/0165240 | A1 | 7/2008 | Hiroki et al. | |
| 2008/0165241 | A1* | 7/2008 | Hiroki et al. | 347/104 |

FOREIGN PATENT DOCUMENTS

JP 2006-193317 7/2006

* cited by examiner

*Primary Examiner* — Matthew Luu
*Assistant Examiner* — Kendrick Liu
(74) *Attorney, Agent, or Firm* — Turocy & Watson, LLP

(57) ABSTRACT

An image forming apparatus includes a sheet stacking unit that stacks and stores the sheet before printing, a first conveying path that conveys the sheet from this sheet stacking unit, a second conveying path that conveys the sheet from this first conveying path to a space between the recording head and a sheet guide member while reversing the sheet, a third conveying path that conveys the sheet from the first conveying path to a temporary storing unit in a state in which a front-to-rear direction of the sheet is maintained, a fourth conveying path that conveys the sheet from the temporary storing unit to the space in a state in which the front-to-rear direction of the sheet is maintained, a first switching mechanism that switches a conveying direction of the sheet, and a second switching mechanism that guides the sheet.

17 Claims, 4 Drawing Sheets

METHOD AND APPARATUS FOR FORMING IMAGE

BACKGROUND OF THE INVENTION

1. Field of the Invention

The present invention relates to an image forming apparatus for printing an image on a sheet such as a print sheet, and, more particularly to an image forming apparatus that has a conveying path suitable for a thick paper while increasing a volume of sheets.

2. Description of the Related Art

There is known an image forming apparatus that has a recording head of an ink jet system and in which a head recording unit moves perpendicularly to a conveying direction of a sheet and performs image formation. In such an image forming apparatus, a sheet cassette is arranged below the head recording unit to increase a volume of sheets and sheets are fed from this sheet cassette. In this case, it is necessary to reduce a conveying path length by reason of, for example, securing printing speed. Therefore, a sheet fed from the sheet cassette passes through a conveying path having a small curvature radius. A U-turn conveying apparatus for reversing a sheet is disclosed in JP-A-2006-193317.

On the other hand, there is also known an image forming apparatus including means for feeding a sheet from a rear surface to secure a large curvature radius.

However, when the sheet cassette is arranged below the head recording unit, since the curvature radius of the conveying path is small, there is a problem in that, when hard paper having sturdiness of a certain degree or more such as a thick paper is fed, for example, creases are left in paper and paper jamming occurs. On the other hand, when the means for feeding a sheet from a rear surface is used, there is a problem in that, for example, dust accumulates when sheets are left untouched.

It is an object of the invention to provide an image forming apparatus and an image forming method that can prevent, when a sheet cassette is arranged below a head recording unit to increase a volume of sheets, creases from being left and paper jamming from occurring even if a thick paper is used.

BRIEF SUMMARY OF THE INVENTION

The invention provides an image forming apparatus that prints an image on a sheet with a recording head of an ink jet system. The image forming apparatus includes a carriage mounted with the recording head, a carriage driving mechanism including a motor for reciprocatingly moving the carriage, a sheet conveying mechanism that conveys the sheet in a direction orthogonal to a moving direction of the carriage, a sheet guide member that has a guide section arranged below the recording head and opposed to the recording head and in which the sheet passes over the guide section, a sheet stacking unit that stacks and stores the sheet before printing, a first conveying path that conveys the sheet from this sheet stacking unit while causing the sheet to pass below the recording head, a second conveying path that conveys the sheet from this first conveying path to a space between the recording head and the sheet guide member while reversing the sheet, a third conveying path that conveys the sheet from the first conveying path to a temporary storing unit in a state in which a front-to-rear direction of the sheet is maintained, a fourth conveying path that conveys the sheet from the temporary storing unit to the space between the recording head and the sheet guide member in a state in which the front-to-rear direction of the sheet is maintained, a first switching mechanism that switches a conveying direction of the sheet fed from the first conveying path between the second conveying path and the third conveying path, and a second switching mechanism that guides the sheet fed from the second conveying path or the third conveying path to the fourth conveying path side.

Objects and advantages of the invention will become apparent from the description, which follows, or may be learned by practice of the invention.

BRIEF DESCRIPTION OF THE SEVERAL VIEWS OF THE DRAWING

The accompanying drawings illustrate embodiments of the invention, and together with the general description given above and the detailed description given below, serve to explain the principles of the invention.

DETAILED DESCRIPTION OF THE INVENTION

Figure 1:
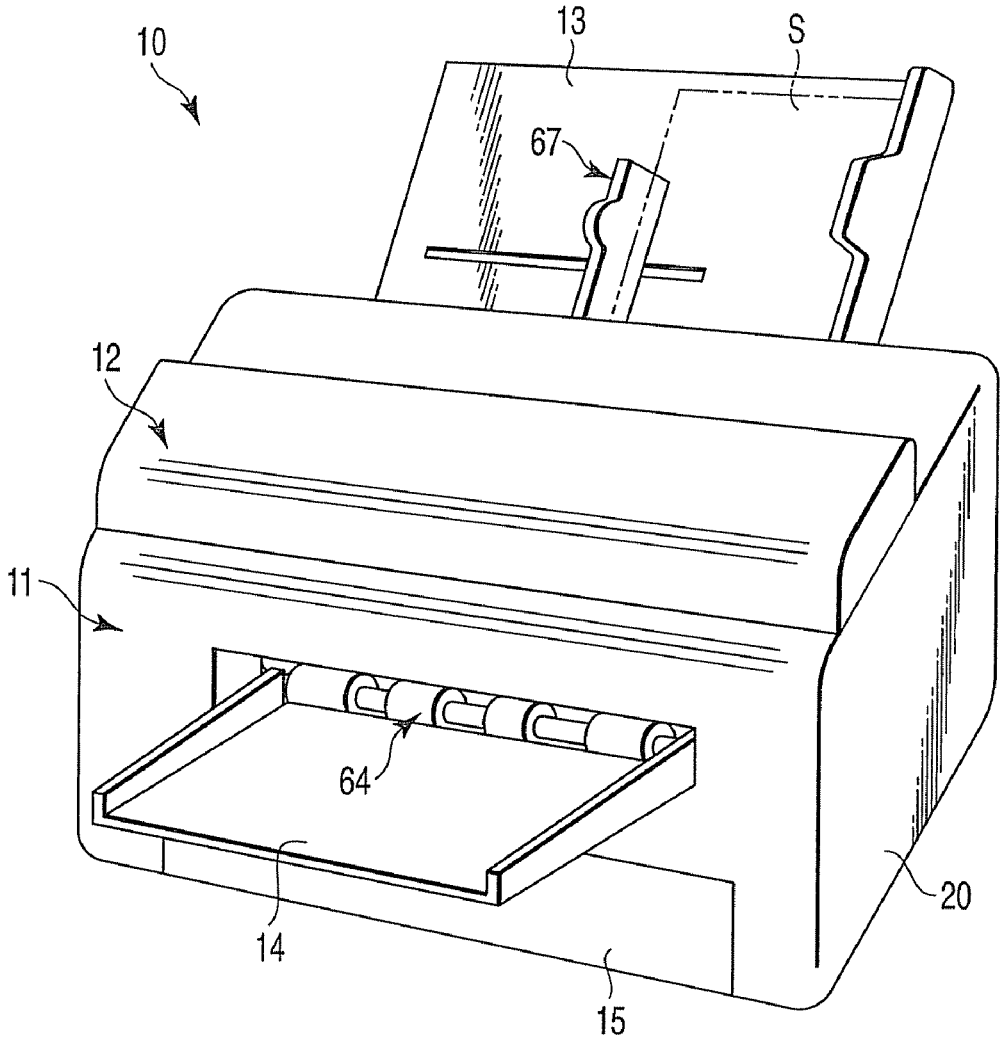
FIG. 1 is a perspective view of an image forming apparatus according to an embodiment of the invention.

An image forming apparatus according to an embodiment of the invention will be explained with reference to FIGS. 1 to 5. FIG. 1 shows an appearance of an image forming apparatus 10. This image forming apparatus 10 has a function of printing an image on a sheet such as a print sheet. As shown in FIG. 1, the image forming apparatus 10 has a main body unit 11, a head housing unit 12 arranged on the main body unit 11, a first feed tray 13 arranged in a rear part of the main body unit 11, a discharge tray 14 arranged in a front part of the main body unit 11, a second feed tray 15 housed in a lower part of the main body unit 11, a third feed tray (a sheet stacking unit) 16, and the like.

Figure 2:
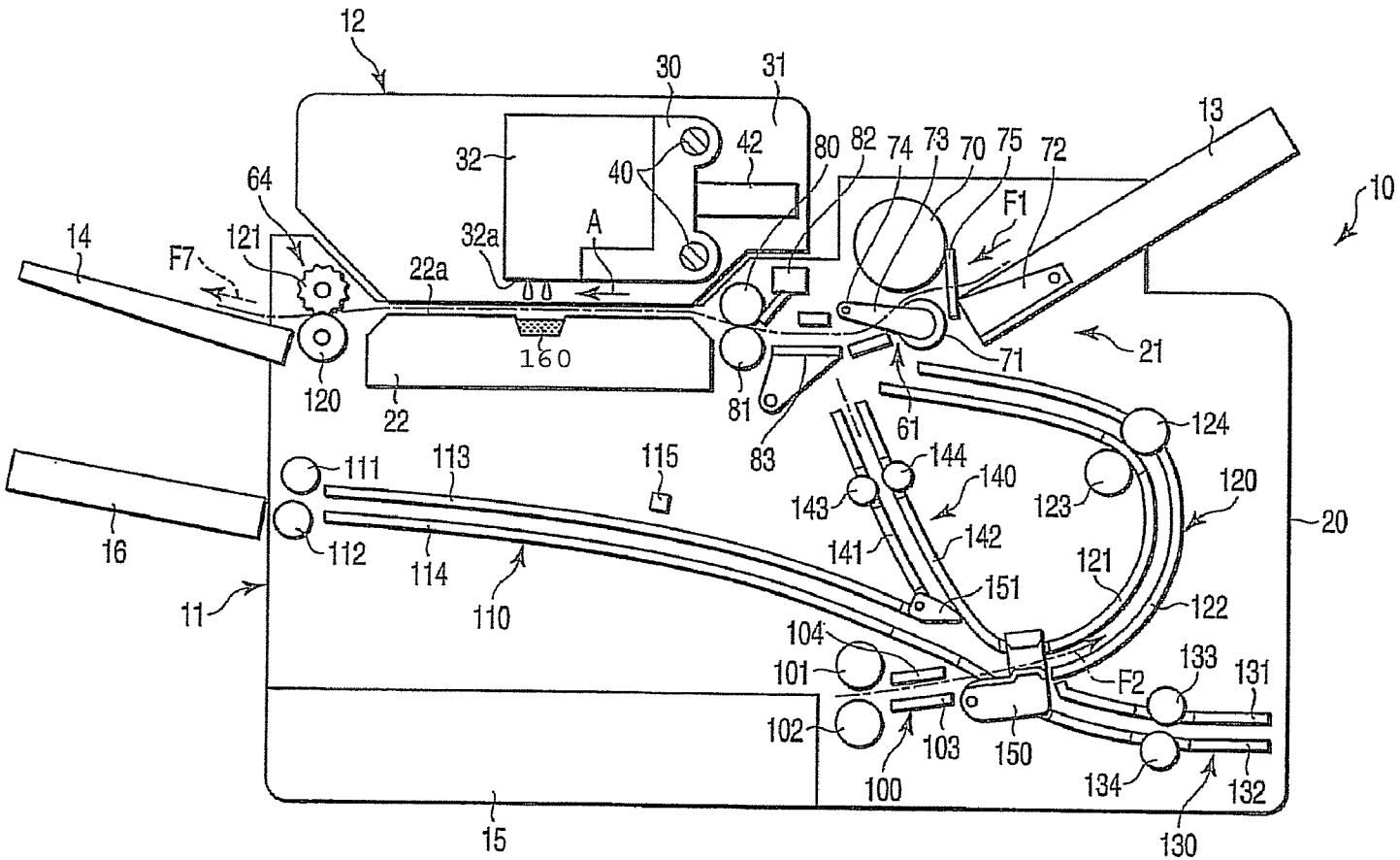
FIG. 2 is a side view schematically showing the inside of the image forming apparatus.

FIG. 2 schematically shows the inside of the image forming apparatus 10. The main body unit 11 includes a housing 20, a sheet conveying mechanism 21 constructed in the inside of the housing 20, a sheet guide member 22 that has a guide section 22*a* in the horizontal direction, and a head cleaning mechanism 24 shown in FIG. 3. The sheet guide member 22 and the head cleaning mechanism 24 are explained in detail later.

A carriage 30, a carriage driving mechanism 31 for driving this carriage 30, a recording head 32 of an ink-jet system mounted on the carriage 30, and the like are arranged in the head housing unit 12. A replaceable ink cartridge (not shown) is housed in the recording head 32. As shown in FIG. 2, the recording head 32 has a nozzle section 32*a* opening downward to the guide section 22*a* of the sheet guide member 22 and an ink ejecting mechanism (not shown) that ejects an ink from the nozzle section 32*a*. The recording head 32 forms an image on a sheet S (shown in FIG. 3) with this ink. An arrow A in FIG. 3 indicates a conveying direction of the sheet S.

An example of the ink ejecting mechanism is a thermal type. The thermal type applies heat to the ink with a heater built in the recording head 32 to film-boil the ink. A pressure change is caused in the ink by growth or contraction of air bubbles due to this film boiling. An image is formed on the sheet S by ejecting the ink from the nozzle section 32*a* according to this pressure change. Other than the thermal type, for example, an ink ejecting mechanism that uses an element (e.g., a piezoelectric element) having a piezoelectric effect may be adopted. For example, the piezoelectric element is deformed by an electric current and an ink is ejected from a nozzle section according to a pumping action based on the deformation.

Figure 3:
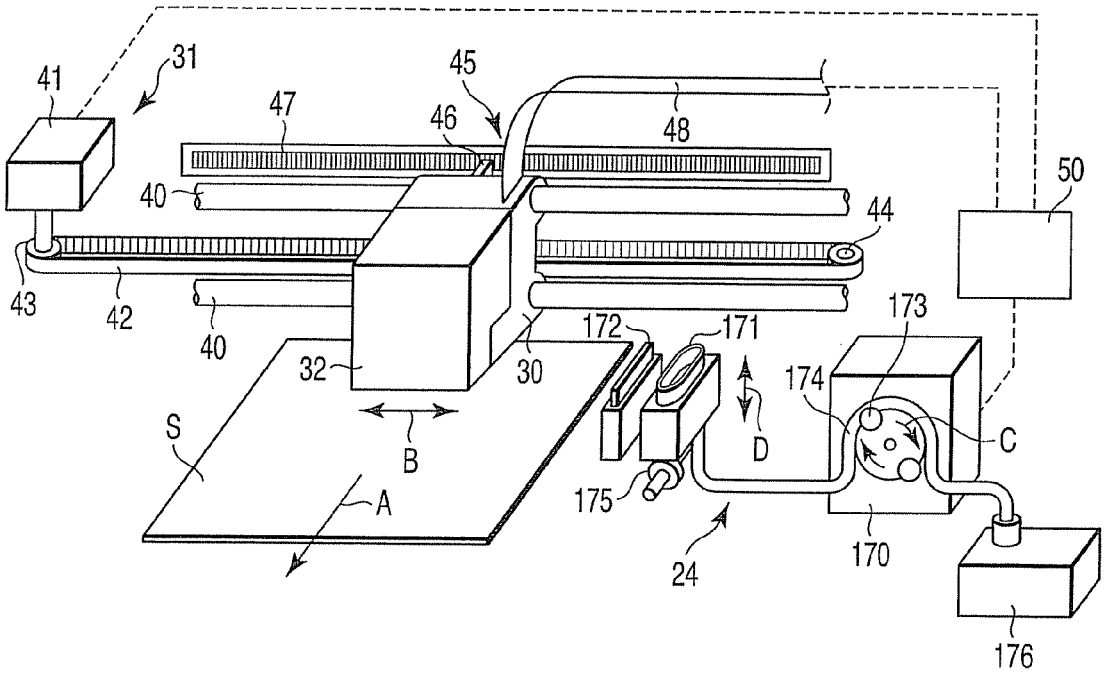
FIG. 3 is a perspective view of a carriage driving mechanism and a head cleaning mechanism of the image forming apparatus.

As shown in FIG. 3, the carriage driving mechanism 31 includes a carriage guide 40 extending in the horizontal direction, a motor 41 such as a stepping motor, power transmitting members such as a timing belt 42 and sprockets 43 and 44, and a sensor unit 45 for controlling a position of the carriage 30. The carriage guide 40 extends in a direction B orthogonal to the conveying direction of the sheet S. The carriage guide 40 is supported by a frame of the head housing unit 12. The recording head 32 is reciprocatingly moved in a direction (the arrow B direction) orthogonal to the conveying direction of the sheet S together with the carriage 30 along the carriage guide 40.

The rotation of the motor 41 is transmitted to the carriage 30 via the timing belt 42. Therefore, the recording head 32 reciprocatingly moves along the carriage guide 40. The sensor unit 45 for controlling a position of the carriage 30 includes, for example, an encoder sensor 46 and a ladder plate 47 serving as a section to be detected. The ladder plate 47 extends in a direction parallel to the carriage guide 40. The ladder plate 47 has a ladder pattern formed at equal pitches. The ladder pattern of the ladder plate 47 is optically detected by the encoder sensor 46 according to the position of the carriage 30, whereby the position of the carriage 30 is detected. A signal of the position detected is inputted to a control unit 50 via a flexible harness 48.

As shown in FIG. 2, the sheet conveying mechanism 21 includes an upper side conveying unit 61 that feeds a sheet from the first feed tray 13, a first conveying unit 100 that feeds a sheet (plain paper) from the second feed tray 15, a second conveying unit (a first conveying path) 110 that feeds a sheet (plain paper or thick paper), a third conveying unit (a second conveying path) 120, a fourth conveying unit (a third conveying path) 130, a fifth conveying unit (a fourth conveying path) 140, and a discharging mechanism 64.

The first conveying unit 62 conveys a sheet taken out from the first feed tray 13 to the recording head 32. The second conveying unit 63 conveys a sheet taken out from the first feed tray 15 to a temporary holding tray 16. The third conveying unit 64 conveys a sheet taken out from the temporary holding tray 16 to the recording head 32. The discharging mechanism 66 has a function of discharging a sheet having an image printed thereon onto the discharge tray 14.

It is possible to place plural sheets (e.g., print sheets) on the first feed tray 13 stacking the sheets in the thickness direction. As shown in FIG. 1, a movable guide 67 is provided in the first feed tray 13. The movable guide 67 is movable in the width direction of the sheet S according to a size of the sheet S. It is possible to regulate a position in the width direction of the sheet S on the first feed tray 13 by moving the movable guide 67 in the width direction of the sheet S.

The upper side conveying unit 61 includes a feed roller 70, a separation roller 71 located below the feed roller 70, and a separation unit 72 including a separation pad. The feed roller 70 feeds a sheet taken out from the lower end of the first feed tray 13 to the recording head 32. A torque limiter is provided in the separation roller 71.

The separation roller 71 rotates in a direction identical with a direction of rotation of the feed roller 70 according to a function of the torque limiter when only one sheet is present between the separation roller 71 and the feed roller 70. When two or more sheets are present between the feed roller 70 and the separation roller 71, the separation roller 71 rotates in a direction opposite to the direction of rotation of the feed roller 70. Therefore, when plural sheets are taken out from the first feed tray 13 and fed into a space between the feed roller 70 and the separation roller 71, an uppermost sheet and the other sheets are separated and only the uppermost sheet is fed to the recording head 32. A sheet separating mechanism for taking out sheets from the first feed tray 13 one by one is constituted by the feed roller 70, the separation roller 71, the separation unit 72, and the like.

The separation roller 71 is held by a holder 73. The holder 73 is movable in the up-to-down direction around a shaft 74 extending in the horizontal direction. The separation roller 71 is brought into contact with the feed roller 70 by a spring at a predetermined load and separated from the feed roller 70 by a not-shown cam. It is possible to move the separation unit 72 in a direction toward and away from the feed roller 70 with a not-shown cam.

After the sheet is fed, the separation roller 71 and the separation unit 72 are separated from the feed roller 70, moved to standby positions, and put on standby until the next sheet feed time, respectively. A return lever 75 is rotatably arranged near the lower end of the first feed tray 13. When the sheet taken out from the first feed tray 13 is conveyed to the feed roller 70, the return lever 75 is retracted by a spring to a position where the return lever 75 does not hinder the conveyance of the sheet. This return lever 75 rotates in synchronization with the movement of the separation roller 71 and the separation unit 72 to the standby positions and feeds a remaining sheet back to the first feed tray 13.

The upper side conveying unit 61 includes a conveying roller 80, a pinch roller 81 opposed to this conveying roller 80, a sheet sensor 82, and a switching member 83. The conveying roller 80 feeds a sheet to a space between the sheet guide member 22 and the recording head 32. The sheet sensor 82 has a sensor arm that is capable of detecting positions of the leading end and the trailing end of the sheet.

Figure 4:
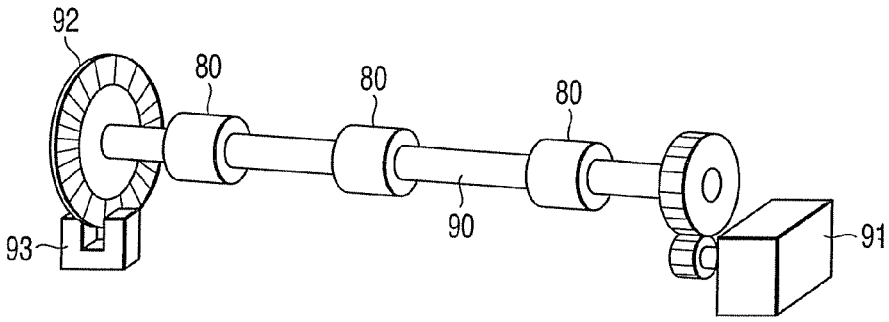
FIG. 4 is a perspective view of a part of a sheet conveying mechanism of the image forming apparatus.
Figure 5:
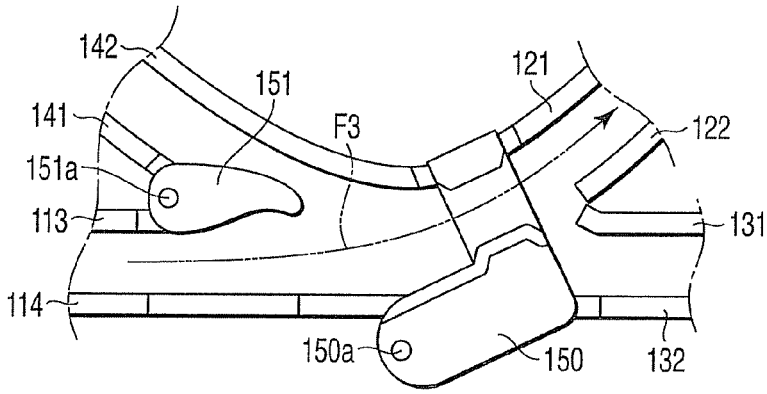
FIG. 5 is a side view schematically showing an operation example of guiding operation in the image forming apparatus.

As shown in FIG. 4, the conveying roller 80 is attached to a shaft 90. The shaft 90 is rotated by a controllable motor 91 such as a stepping motor. The pinch roller 81 opposed to the conveying roller 80 is set in contact with the conveying roller 80 by a not-shown spring. A ladder wheel 92 of a disc shape is attached to the shaft 90 of the conveying roller 80. A ladder pattern is formed in a circumferential direction at fixed pitches in the ladder wheel 92. This ladder wheel 92 is detected by a sensor 93 and detected signal is inputted to the control unit 50. Consequently, the rotation of the conveying roller 80 is controlled and conveyance of a sheet is controlled at the time of image formation.

A sheet taken out from the first feed tray 13 by the feed roller 70 is conveyed to a space between the conveying roller 80 and the pinch roller 81 through the upper side conveying unit 61 as indicated by an arrow F1 in FIG. 2. The leading end of the sheet is detected by the sheet sensor 82 and positioning for image formation is performed. This sheet passes between the upper surface (the guide section 22*a*) of the sheet guide member 22 and the recording head 32 according to the rotation of the conveying roller 80. When the sheet passes, an image is formed on the sheet S by the recording head 32. Ribs functioning as a conveyance reference surface are formed on the guide section 22*a* of the sheet guide member 22. These ribs keep the height of the sheet proper and prevent the sheet from heaving. The sheet having the image formed thereon is conveyed to the discharging mechanism 64.

The first conveying unit 100 includes rollers 101 and 102 for taking out a sheet from the second feed tray 15 of a cassette type and guide members 103 and 104 for guiding the sheet taken out. It is possible to store plural sheets (e.g., plain paper) in the second feed tray 15 stacking the sheets in the thickness direction. The rollers 101 and 102 function as sheet separating mechanisms for taking out sheets from the second feed tray 15 one by one.

The second conveying unit (the first conveying path) 110 includes rollers 111 and 112 for taking out a sheet from the third feed tray 16 of a cassette type, guide members 113 and 114 for guiding the sheet taken out, and a media sensor 115 provided along the guide members 113 and 114. It is possible to store plural sheets (e.g., thick paper) in the third feed tray 16 stacking the sheets in the thickness direction. The rollers 111 and 112 function as sheet separating mechanisms for taking out sheets from the third feed tray 16 one by one.

The media sensor 115 has a function of detecting a quality (e.g., paper quality) of a sheet. For example, when the surface of the sheet is made of a material having moisture-absorption characteristics, the media sensor 115 outputs a signal for increasing a quantity of ink ejected from the recording head 32 to the control unit 50. In the case of a sheet having glossiness on the surface thereof, for example, coat paper, the media sensor 115 performs control for outputting a signal for reducing a quantity of ink ejected from the recording head 32 to the control unit 50. In the case of color printing, a ratio of ejection of plural color elements may be adjusted on the basis of a signal from the media sensor 115.

The third conveying unit (the second conveying path) 120 is provided with guide members 121 and 122 for guiding a sheet taken out and a conveying roller 123 and a pinch roller 124 provided along these guide members 121 and 122.

The fourth conveying unit (the third conveying path) 130 is provided with guide members (temporary storing units) 131 and 132 for guiding and temporarily holding a sheet taken out from the second conveying unit 110 and a conveying roller 133 and a pinch roller 134 provided along these guide members 131 and 132.

The fifth conveying unit (the fourth conveying path) 140 is provided with guide members 141 and 142 that guide a sheet taken out from the fourth conveying unit 130 and a conveying roller 143 and a pinch roller 144 provided along these guide members 141 and 142.

A flapper (a first switching mechanism) 150 that guides a sheet is provided in a confluent position of the first conveying unit 100, the third conveying unit 120 and the fourth conveying unit 130. The flapper 150 is usually in a position shown in FIG. 2 and swings around a swing shaft 150*a* at predetermined timing. Operation timing will be described later.

A flapper (a second switching mechanism) 151 that guides a sheet is provided in a confluent position of the second conveying unit 110 and the fifth conveying unit 140. The flapper 151 is usually in a position shown in FIG. 2 and swings around a swing shaft 151*a* at predetermined timing. Operation timing will be described later.

Here, a method of conveying a sheet from the second feed tray 15 will be explained. After being taken out from the second feed tray 15 by the rollers 101 and 102 one by one, the sheet passes between the guide members 103 and 104. As indicated by an arrow F2 in FIG. 2, the sheet is guided to the third conveying unit 120 by the flapper 150 and passes between the guide members 121 and 122. Moreover, this sheet is conveyed to the conveying roller 80 by the conveying roller 123 and the pinch roller 124 and fed to a space between the recording head 32 and the sheet guide member 22. Although the third conveying unit 120 has a small curvature, if a sheet stored in the second feed tray 15 is a thin sheet such as plain paper, creases are not left in the sheet and paper jamming does not occur.

A method of conveying a sheet from the third feed tray 16 will be explained. After being taken out from the second feed tray 15 by the rollers 111 and 112 one by one, the sheet passes between the guide members 113 and 114. When the sheet passes, thickness and surface roughness of the sheet are detected by the media sensor 115 and a type of the sheet is discriminated. Here, when the type of the sheet is plain paper, as indicated by an arrow F3 in FIG. 5, the sheet is guided to the third conveying unit 120 by the flapper 150 and passes between the guide members 121 and 122. Moreover, this sheet is conveyed to the conveying roller 80 by the conveying roller 123 and the pinch roller 124 and fed to the space between the recording head 32 and the sheet guide member 22. Although the third conveying unit 120 has a small curvature, if a sheet stored in the third feed tray 16 is a thin sheet such as plain paper, creases are not left in the sheet and paper jamming does not occur.

Figure 6:
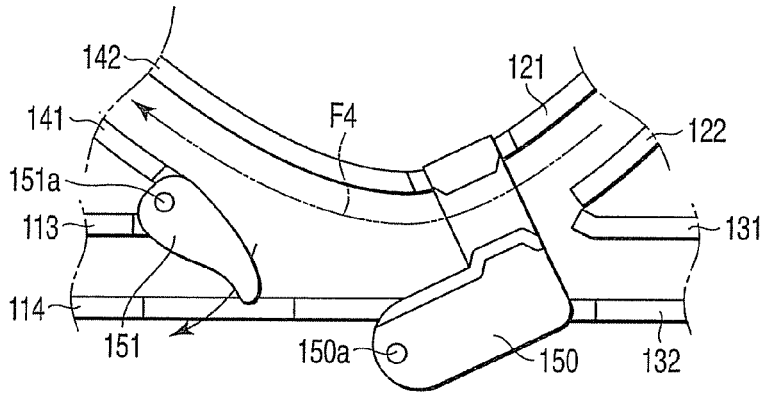
FIG. 6 is a side view schematically showing the operation example of the guiding operation in the image forming apparatus.

When an image is printed on the rear side of plain paper as well, after an image is printed on one side of a sheet by the recording head 32, the trailing end of this sheet is detected by the sheet sensor 82. Immediately after the detection, the conveying roller 80 rotates reversely. The flapper 151 swings to a position shown in FIG. 6. The sheet is fed reversely through the third conveying unit 120. As indicated by an arrow F4 in FIG. 6, the sheet is guided to the fifth conveying unit 140 and passes between the guide members 141 and 142. Moreover, this sheet is conveyed to the conveying roller 80 by the conveying roller 143 and the pinch roller 144 and fed to the space between the recording head 32 and the sheet guide member 22 in a state in which the front and the rear thereof are reversed.

Figure 7:
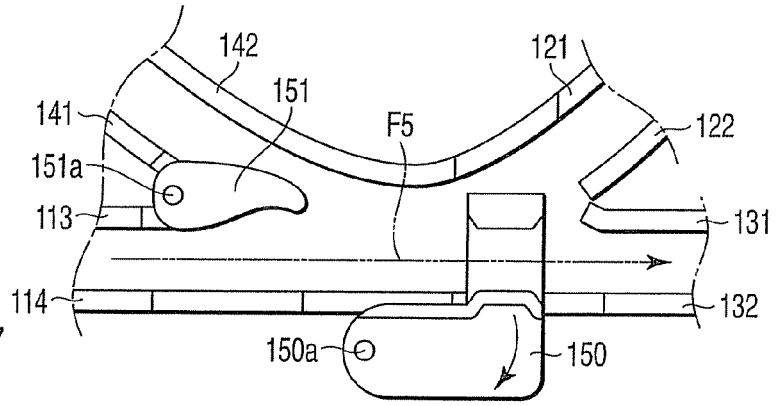
FIG. 7 is a side view schematically showing the operation example of the guiding operation in the image forming apparatus.
Figure 8:
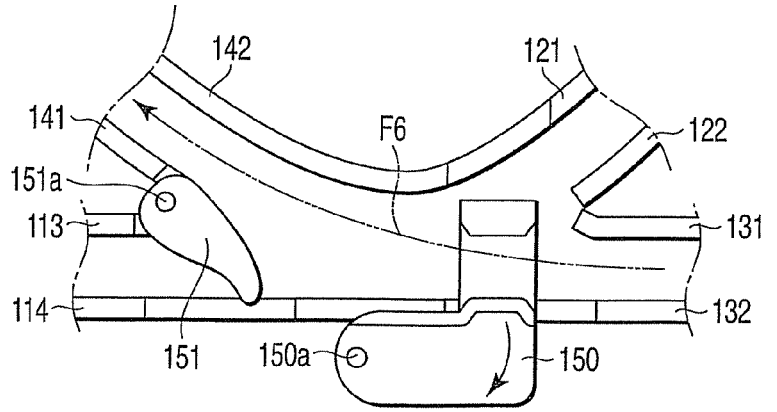
FIG. 8 is a side view schematically showing the operation example of the guiding operation in the image forming apparatus.

On the other hand, when the type of the sheet is a thick paper, since the thick paper is sturdy, when the sheet is caused to pass through the third conveying unit 120 having a small curvature, it is likely that creases are left in the sheet and paper jamming occurs. Therefore, the sheet is caused to pass through the fourth conveying unit 130 and the fifth conveying unit 140 having a large curvature. In other words, as indicated by an arrow F5 in FIG. 7, the sheet is guided to the fourth conveying unit 130 by the flapper 150 and passes between the guide members 131 and 132. Moreover, this sheet is conveyed to the end of the fourth conveying unit 130 by the conveying roller 133 and the pinch roller 134 and temporarily held. Subsequently, the flapper 151 swings to a position shown in FIG. 8. As indicated by an arrow F6 in FIG. 8, the sheet is fed reversely through the third conveying unit 120 and guided to the fifth conveying unit 140 and passes between the guide members 141 and 142. Moreover, this sheet is conveyed to the conveying roller 80 by the conveying roller 143 and the pinch roller 144 and fed to the space between the recording head 32 and the sheet guide member 22.

Finally, the sheets from the second feed tray 15 and the third feed tray 16 are conveyed to the space between the conveying roller 80 and the pinch roller 81 and images are formed on the sheets S by the recording head 32 in the same manner as the sheet from the first feed tray 13 described above. The sheets are conveyed to the discharging mechanism 66.

The conveying rollers 80, 101, 111, 123, 133, and 143 are obtained by providing rubber-like resin such as EPDM (ethylene propylene diene rubber) on a metal shaft and have a function of conveying the sheet S with friction.

The discharging mechanism 64 has a discharge roller 150, a star wheel 151, a transmitting mechanism (not shown) for transmitting the rotation of the conveying roller 80 to the discharge roller 150 and the star wheel 151, and the like. The star wheel 151 is a wheel of a gear shape made of a thin plate of stainless steel or the like. A sheet having an image printed thereon by the recording head 32 is conveyed in a direction indicated by an arrow F7 to the discharge tray 14 while being pressed against the discharge roller 150 by the star wheel 151. The sheet after printing is prevented from floating from the discharge roller 150 by this start wheel 151.

As shown in FIG. 2, an ink absorbing section 160 is formed on the upper surface side of the sheet guide member 22. The ink absorbing section 160 is opposed to the nozzle section 32*a* of the recording head 32 and formed in a position lower than the guide section 22*a*. The width of the ink absorbing section 160 is larger than the width of the sheet S. When rimless printing on a sheet is performed, all excess ink ejected on the outside of the edge of the sheet is absorbed by this ink absorbing section 160, whereby following sheets are prevented from being stained.

The head cleaning mechanism 24 shown in FIG. 3 includes a suction pump 170 for performing cleaning of the recording head 32, a cap 171 for preventing the recording head 32 from drying, and a blade member 172 for cleaning the nozzle section 32*a* of the recording head 32. An example of the suction pump 170 strokes a tube 174 in a direction indicated by an arrow C with a body of rotation 173 to generate a negative pressure on the inner side of the cap 171.

It is possible to move the cap 171 in an up-to-down direction (an arrow D direction in FIG. 3) with a driving unit 175. The driving unit 175 moves the cap 171 up and down with an electric actuator 176 such as a solenoid as a driving source. The rotation of a motor may be converted into a linear motion by a cam, a link mechanism, or the like to move the cap 171 up and down. In maintaining the recording head 32, the cap 171 is lifted to the recording head 32 to bring the cap 171 into close contact with the recording head 32. In this state, the suction pump 170 is actuated to suck an excess ink adhering to the nozzle section 32*a* of the recording head 32. The waste ink sucked is discharged into a waste ink tank 176. Thereafter, the cap 171 moves away from the recording head 32 and the nozzle section 32*a* of the recording head 32 is cleaned by the blade member 172.

According to the respective embodiments, when a sheet cassette is arranged below a head recording unit to increase a volume of sheets, it is possible to prevent creases from being left and paper jamming from occurring even if a thick paper is used.

It is also possible to apply the invention to an image forming apparatus for printing an image on sheets other than a print sheet, for example, sheets made of paper of various forms, cloth, plastics, and the like.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the invention as defined by the appended claims and equivalents thereof.

What is claimed is:

1. An image forming apparatus that prints an image on a sheet, the image forming apparatus comprising:

means for conveying the sheet in a predetermined direction;

means for recording the sheet with a head of an ink jet system;

means for stacking the sheet before printing and storing the sheet in a sheet stacking unit;

means for conveying the sheet from the sheet stacking unit via a first conveying path below the recording head;

means for conveying the sheet from the first conveying path to the recording head side via a second conveying path while reversing the sheet;

means for conveying the sheet from the first conveying path to a temporary storing unit via a third conveying path in a state in which a front-to-rear surface of the sheet is maintained;

means for conveying the sheet from the temporary storing unit to the recording head side via a fourth conveying path in a state in which the front-to-rear surface of the sheet is maintained;

means for switching a conveying direction of the sheet fed from the first conveying path between the second conveying path and the third conveying path; and means for guiding the sheet fed from the second conveying path or the third conveying path to the fourth conveying path side.

2. An image forming apparatus according to claim 1, wherein the fourth conveying path conveys a sheet, which is fed from the second conveying path and on one side of which an image is formed by the recording head, to the recording head side.

3. An image forming apparatus according to claim 1, wherein the first conveying path and the third conveying path are arranged substantially horizontally.

4. An image forming apparatus according to claim 1, wherein the sheet fed from the first conveying path is switched to the second conveying path or the third conveying path on the basis of a type of the sheet.

5. The image forming apparatus according to claim 1, further comprising:

means for moving the recording head in a direction orthogonal to the conveying direction of the sheet; and means for ejecting an ink from the recording head to the sheet to form an image on the sheet.

6. An image forming apparatus according to claim 1, wherein a front end of the sheet transported into the temporal containing unit by the means for transporting the sheet through the third transport path corresponds to a back end of the sheet transported out of the temporal containing unit by the means for transporting the sheet through the fourth transport path.

7. An image forming apparatus according to claim 2, further comprising a media sensor to discriminate a type of the sheet.

8. An image forming apparatus according to claim 3, wherein a media sensor is provided in the first conveying path.

9. An image forming method of printing an image on a sheet, the image forming method comprising:

conveying the sheet in a predetermined direction;

recording the sheet with a head of an ink jet system;

stacking the sheet before printing and storing the sheet in a sheet stacking unit;

conveying the sheet from the sheet stacking unit via a first conveying path below the recording head;

conveying the sheet from the first conveying path to the recording head side via a second conveying path while reversing the sheet;

conveying the sheet from the first conveying path to a temporary storing unit via a third conveying path in a state in which a front-to-rear surface of the sheet is maintained;

conveying the sheet from the temporary storing unit to the recording head side via a fourth conveying path in a state in which the front-to-rear surface of the sheet is maintained;

switching a conveying direction of the sheet fed from the first conveying path between the second conveying path and the third conveying path; and guiding the sheet fed from the second conveying path or the third conveying path to the fourth conveying path side.

10. An image forming method according to claim 9, wherein the fourth conveying path conveys a sheet, which is fed from the second conveying path and on one side of which an image is formed by the recording head, to the recording head side.

11. An image forming method according to claim 9, wherein the first conveying path and the third conveying path are arranged substantially horizontally.

12. An image forming method according to claim 9, wherein the sheet fed from the first conveying path is switched to the second conveying path or the third conveying path on the basis of a type of the sheet.

13. An image forming method according to claim 11, wherein the type of the sheet is discriminated by a media sensor.

14. An image forming method according to claim 12, wherein the media sensor is provided in the first conveying path.

15. An image forming apparatus that prints an image on a sheet, the image forming apparatus comprising:

a sheet conveying mechanism that conveys the sheet in a predetermined direction;

a sheet stacking unit that stacks the sheet before printing and storing the sheet in a sheet stacking unit;

a head of an ink jet system that records the sheet;

a first conveying path that conveys the sheet from the sheet stacking unit via a first conveying path below the recording head;

a second conveying path that conveys the sheet from the first conveying path to the recording head side via a second conveying path while reversing the sheet;

a third conveying path that conveys the sheet from the first conveying path to a temporary storing unit via a third conveying path in a state in which a front-to-rear surface of the sheet is maintained;

a fourth conveying path that conveys the sheet from the temporary storing unit to the recording head side via a fourth conveying path in a state in which the front-to-rear surface of the sheet is maintained;

a first switching mechanism that switches a conveying direction of the sheet fed from the first conveying path between the second conveying path and the third conveying path; and a guiding unit that guides the sheet fed from the second conveying path or the third conveying path to the fourth conveying path side.

16. The image forming apparatus according to claim 15, further comprising:

a moving unit that moves the recording head in a direction orthogonal to the conveying direction of the sheet; and an ejecting unit that ejects an ink from the recording head to the sheet to form an image on the sheet.

17. The image forming apparatus according to claim 15, wherein a radius of a curvature of the second conveying path is smaller than a curvature of each of the third and the fourth conveying paths.

* * * * *